US007250833B2

(12) United States Patent
Eddy

(10) Patent No.: US 7,250,833 B2
(45) Date of Patent: Jul. 31, 2007

(54) METHOD AND APPARATUS FOR STABILIZING THE TEMPERATURE OF DIELECTRIC-BASED FILTERS

(75) Inventor: Michael Eddy, Santa Barbara, CA (US)

(73) Assignee: Antone Wireless Corporation, Goleta, CA (US)

( * ) Notice: Subject to any disclaimer, the term of this patent is extended or adjusted under 35 U.S.C. 154(b) by 75 days.

(21) Appl. No.: 11/199,772

(22) Filed: Aug. 8, 2005

(65) Prior Publication Data

US 2006/0033596 A1 Feb. 16, 2006

Related U.S. Application Data

(60) Provisional application No. 60/601,745, filed on Aug. 13, 2004.

(51) Int. Cl.
*H01P 1/20* (2006.01)

(52) U.S. Cl. ..... 333/202; 333/229; 333/234; 333/99 S

(58) Field of Classification Search ..... 333/202, 333/229, 234, 99 S
See application file for complete search history.

(56) References Cited

U.S. PATENT DOCUMENTS 5,995,851 A * 11/1999 Lim ..... 455/561
6,212,404 B1 4/2001 Hershtig
6,480,706 B1 * 11/2002 Mimura et al. ..... 455/140
6,496,087 B1 * 12/2002 Hattori et al. ..... 333/202

FOREIGN PATENT DOCUMENTS

GB 2 338 478 A 12/1999

OTHER PUBLICATIONS

Pullar, R.C., et al., "Dielectric Loss of Titanium Oxide," London South Bank University, 8 pp., Jul. 30, 2004.

* cited by examiner

*Primary Examiner*—Robert Pascal
*Assistant Examiner*—Kimberly E Glenn
(74) *Attorney, Agent, or Firm*—Vista IP Law Group LLP

(57) ABSTRACT

A dielectric-based filter includes a thermally insulated housing, at least one filter formed from a dielectric material disposed inside the insulated housing, and a temperature maintenance device having a heating component and a cooling component for maintaining the temperature of the filter inside of the insulated housing within a temperature range. In a preferred aspect of the invention, the temperature maintenance device includes a thermoelectric cooler. The device permits the use of temperature-dependent low loss, high dielectric constant materials in filtering/resonator applications. During operation of the device, the dielectric-based filter is maintained at substantially room temperature.

19 Claims, 3 Drawing Sheets

METHOD AND APPARATUS FOR STABILIZING THE TEMPERATURE OF DIELECTRIC-BASED FILTERS

REFERENCE TO RELATED APPLICATIONS

This Application claims priority to U.S. Provisional Patent Application No. 60/601,745 filed on Aug. 13, 2004. U.S. Provisional Patent Application No. 60/601,745 is incorporated by reference as if set forth fully herein.

FIELD OF THE INVENTION

The field of the invention generally relates to dielectric-based filters (or resonators) used, for example, in base station filters in wireless applications. More specifically, the field of the invention relates to temperature stabilizing methods and devices incorporating low loss, high dielectric constant materials.

BACKGROUND OF THE INVENTION

Wireless base stations operating using one or more dielectric filters comprised of resonator "pucks" are becoming more common because of increasing demands for filtering of signals both on the transmit and receive sides. Dielectric-based resonators are attractive for wireless applications because they have low loss (i.e., high Q values). Unfortunately, there are a number of limitations with current dielectric-based resonators. First, current dielectric materials tend to be very sensitive to temperature changes. As the temperature of the dielectric material changes, the dielectric constant and dimensions of the material will also change, thereby causing an adverse shift in frequency. Second, current filters which are formed from dielectric materials tend to be large and bulky due the large volume of dielectric material needed to form the individual filters. Both of these limitations result in the added cost associated with dielectric filters relative to metal cavity filters Attempts have been made to combine multiple materials with offsetting temperature properties to compensate for the temperature dependency problems. In this solution, materials with different affects on the dielectric constant are combined in order to stabilize the temperature variations. Unfortunately, this leads to a lowering of the average dielectric constant of the dielectric material. Consequently, a large volume of material is needed in these solutions. Moreover these solutions produce filters with increased overall loss (lower Q values). There also is the disadvantage that actual construction of the filter requires bimetals/multiple metals to compensate for the different thermal properties between the housing (or stage) and the dielectric component.

There thus is a need for a device/method which can reduce or eliminate entirely the adverse temperature dependencies found in current dielectric-based resonators/filters. The device/method preferably allows the use of dielectric materials having high dielectric constants in a range of temperature environments.

SUMMARY OF THE INVENTION

A dielectric-based filter includes a thermally insulated housing, at least one filter formed using a dielectric material disposed inside the insulated housing, and a temperature maintenance device having a heating component and a cooling component for maintaining the temperature of the filter inside of the insulated housing within a temperature range. In a preferred aspect of the invention, the temperature maintenance device includes a thermo-electric cooler. The device permits the use of temperature-dependent low loss, high dielectric constant materials in filtering/resonator applications.

In another aspect of the invention, a method of stabilizing the temperature of dielectric-based filters includes the steps of providing an insulated housing and at least one filter formed using a dielectric material disposed inside the insulated housing. A temperature maintenance device is provided having a heating component and a cooling component for maintaining the temperature of the at least one filter within a temperature range. The at least one filter in the insulated housing is heated with the heating component when the temperature falls below a threshold value. The at least one filter in the insulated housing is cooled with the cooling component when the temperature rises above a threshold value.

It is an object of the invention to provide a method and device for stabilizing the temperature of temperature-dependent dielectric materials used in filters/resonators. The method and device maintains the temperature of the dielectric materials using a temperature maintenance device having cooling/heating capabilities. Preferably, the temperature is maintained within a relatively small range in order to limit the effects on the dielectric constant of the materials used in the filter/resonator. The temperature at which the filters are maintained is at or around room temperature (i.e., around 25° C.). Unlike cryogenic-based systems, the goal of the present invention is to maintain the filters/resonators at or near room temperature through a combination of heating/cooling.

The invention also contemplates the addition of other components of the transmit/receiver chain inside the temperature controlled housing. These include, for example, low noise amplifiers (LNAs), A-D converters, D-A converters, and the like. These components are relatively small and demand minimal heat dissipation. Nonetheless, it may advantageous to include one or more of these components inside the temperature controlled housing. For example, it may extend the life of these components because they are maintained at or near room temperature (thus not exposing the components to extreme temperature swings).

DETAILED DESCRIPTION OF THE INVENTION

Figure 1:
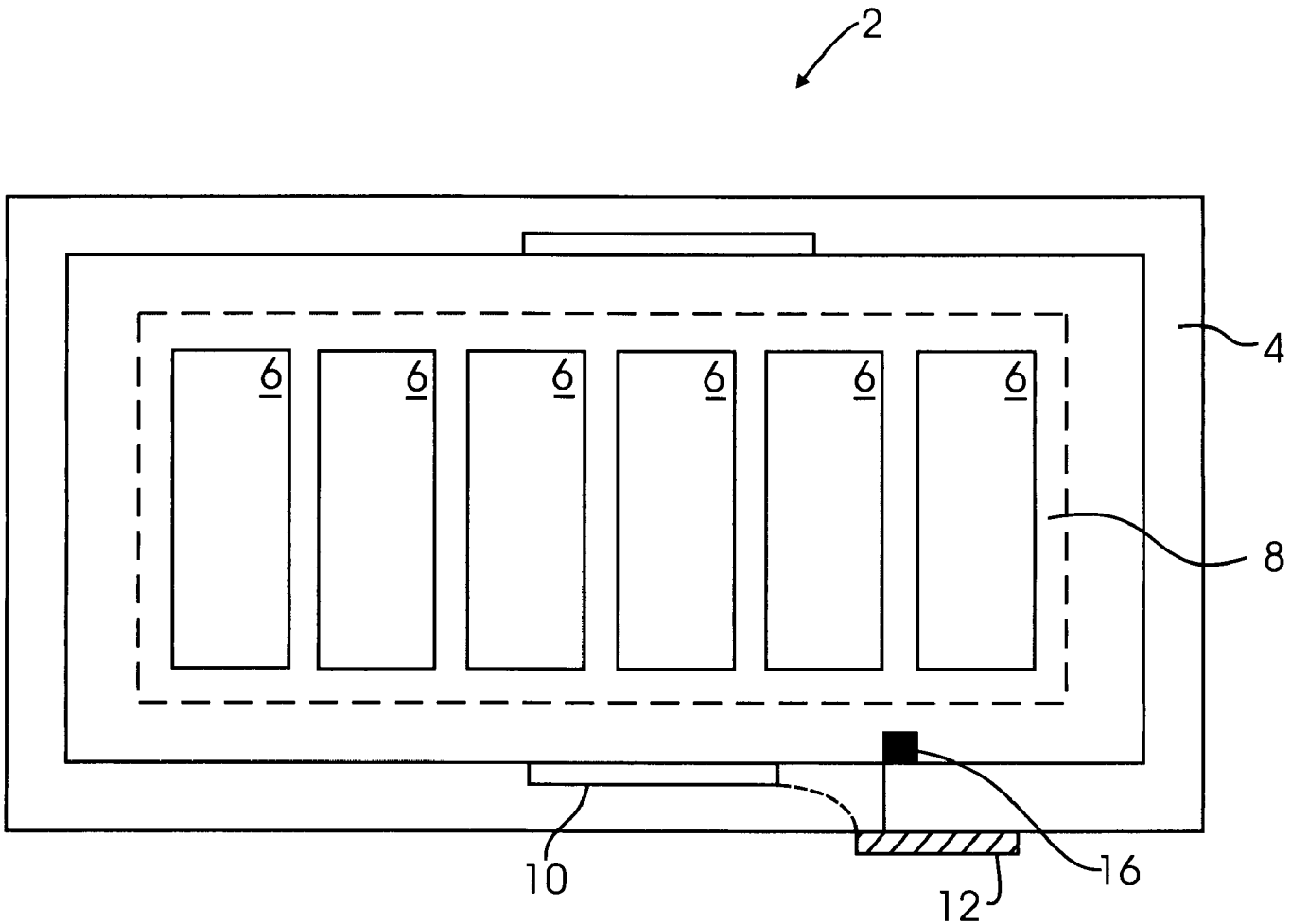
FIG. 1 illustrates a dielectric-based filter device according to one preferred aspect of the invention.
Figure 2:
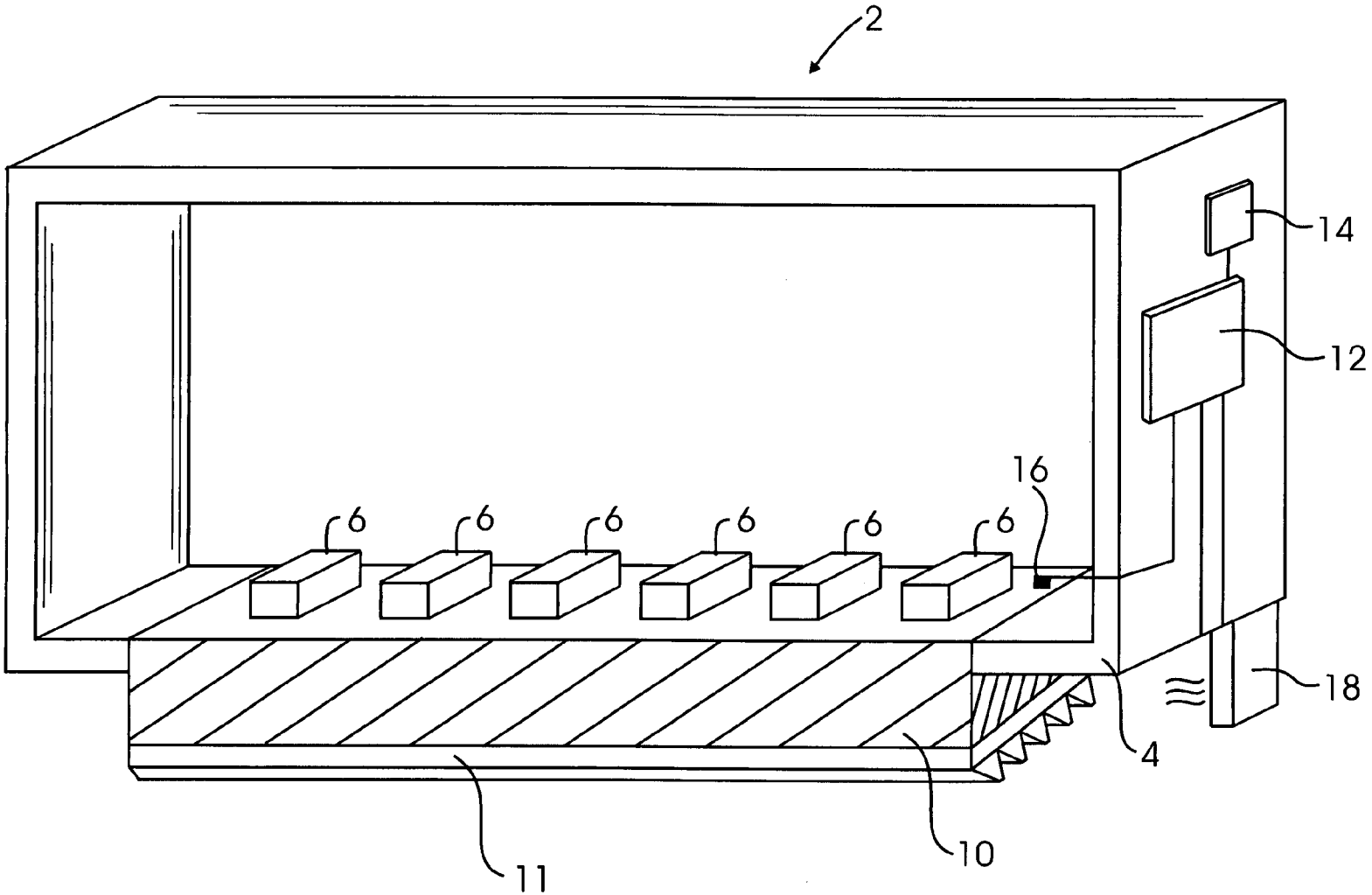
FIG. 2 illustrates a three dimensional view of the interior of the housing from a dielectric-based device according to another preferred aspect of the invention.
Figure 3:
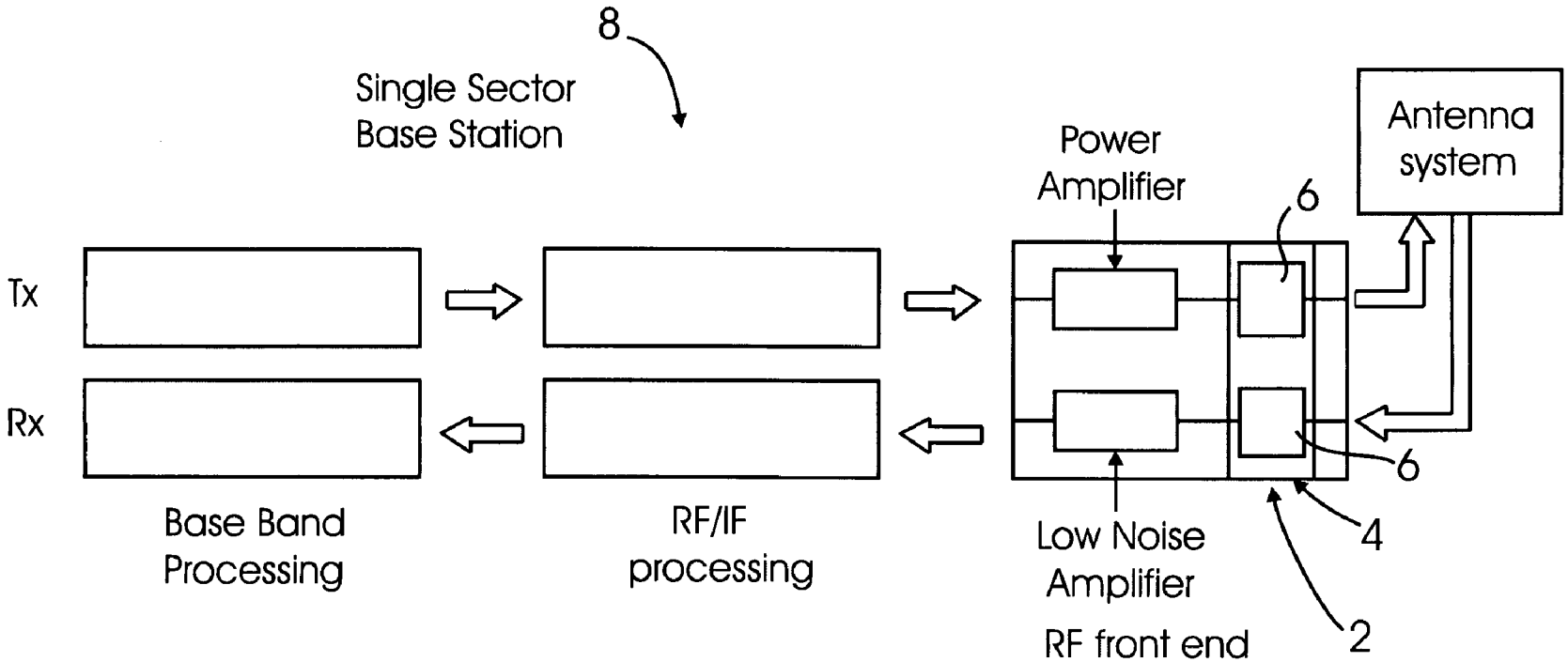
FIG. 3 illustrates schematically illustrates a single sector of base station incorporating the temperature controlled dielectric-based filter according to the present invention.

FIG. 1 illustrates a dielectric-based device 2 according to a preferred aspect of the invention. The device 2 includes a housing 4 or other compartment containing one or more filters 6. As best shown in FIG. 2, the filters 6 are filters which include a metal housing having a plurality of holes or cavities therein. Dielectric "pucks" are then placed inside the holes in the metal housing to form the complete three-dimensional filter 6. Such filters are known to those skilled in the art. The housing 4 is preferably formed from a thermally insulative material such as, for example, foam. It should be appreciated, however, that other thermal insulators may also be used in accordance with the present invention. The housing 4 may even have one or more thermally insulative layers deposited on a thermally conductive material. For example, the housing 4 may comprise a metallic or thermally conductive interior which is surrounded on the exterior with a thermal insulator such as foam or the like. The housing 4 may be under vacuum or may be exposed to atmospheric or ambient pressures. The filters 6 are preferably used to filter receive and/or transmit signals in a base station 8 as is shown in FIG. 3. In this regard, the filters 6 may be used in only transmit or receive applications. Alternatively, the filters 6 may be used as duplexers (both transmit and receive).

The filters 6 are preferably formed from a dielectric material having low loss (high Q value) and high dielectric constant. Preferably, the dielectric material has a dielectric constant exceeding 50. In one preferred aspect of the invention, the dielectric material comprises $TiO_2$ doped with one or more cations. Preferably, the valency of the cation(s) ranges from +1 to +6. United Kingdom Publication No. GB2338478 dated Dec. 22, 1999, which is incorporated by reference as if set forth fully herein discloses suitable examples of doped $TiO_2$. Suitable materials are also disclosed in the publication entitled *Dielectric Loss of Titanium Oxide,* R. C. Pullar, P. K. Petrov, S. J. Penn, X. Wang, and N. McN. Alford, London South University (on Internet at www.eeie.sbu.ac.uk/research/pem/reports/ TiO2%20EPSRC%20Final%20Report.pdf). This publication is incorporated by reference as if set forth fully herein.

The filters 6 are preferably disposed on an optional stage 8 inside the housing 4. The stage 8 may be in the form of a heat sink or the like to enable the filters 6 to better maintain temperature stability. In a preferred aspect of the invention, the device 2 includes a temperature maintenance device 10. As seen in FIG. 1, the temperature maintenance device 10 interfaces with the housing 4. The temperature maintenance device 10 is used to both cool and heat the filters 6 contained within the housing 4 such that the filters 6 are maintained at a substantially constant temperature. Preferably, the temperature maintenance device 10 includes both a heating component and a cooling component. In this regard, when the temperature of the filters 6 (or interior of housing 4 or stage 8) is too low (such as below a pre-determined threshold temperature), the heating component transfers heat to the filters 6 (i.e., heats) to maintain their temperature. Conversely, when the temperature of the filters 6 (or interior of housing 4 or stage 8) is too high (such as above a predetermined threshold temperature), the cooling component transfers heat out of the housing 4 (thereby cooling the filters 6) to maintain a substantially constant filter temperature.

In one preferred embodiment, the temperature maintenance device 10 may comprise a thermo-electric cooler (e.g., a Peltier cooler). This type of cooler is preferred because it is relatively inexpensive and provides enough heating/cooling capacity to maintain the filters 6 within a relatively narrow range of temperatures. The housing 4 may also include a fan component 18 as shown in FIG. 2 to dissipate the heat created during its operation. Preferably, the temperature maintenance device 10 is able to maintain the temperature of the filters 6 within the temperature range of about +/−0.1 to 0.5 K. Generally, materials with higher dielectric constants require smaller temperature variations.

In one aspect of the invention, a single temperature maintenance device 10 is used to heat/cool all the filters 6. In an alternative embodiment, however, each filter 6 may be associated with its own temperature maintenance device 10. It is even possible to share multiple filters 6 among multiple temperature maintenance devices 10.

Referring back to FIG. 1, the device 2 preferably includes a temperature controller 12. The temperature controller 12 advantageously controls the heating and cooling components of the temperature maintenance device 10. Namely, the temperature controller 12, which may be microprocessor-based, is used to selectively heat/cool the filters 6 (or housing 4 or stage 8) to maintain the temperature of the filters 6 within the desired range. In one aspect, as is shown in FIG. 1, a power supply is integrated into the temperature controller 12. However, as seen in FIG. 2, the power supply 14 may be separate form the temperature controller 12. The power supply 14 may include batteries or other energy storage device. Alternatively, the power supply 14 may comprise a power converter, for example, which may convert alternating current to direct current needed to power the various subsystems of the device 2.

Preferably, at least one temperature sensor 16 is coupled to the temperature controller 12. In this manner, temperature input signals or the like can be used to control the heating/cooling of the filters 6. Any number of known feedback arrangements may be used in the temperature controller 12 to control the temperature maintenance device 10. The temperature sensor(s) 16 may be located within the housing 4, on the stage 8, or even directly on the filters 6.

FIG. 2 illustrates yet another embodiment of the device 2. FIG. 2 illustrates a temperature controller 12 coupled to separate power supply 14. In addition, the temperature controller 12 is connected to the temperature maintenance device 10. Temperature measurements are taken with a temperature sensor 16 and communicated to the temperature controller 12. FIG. 2 also illustrates an optional fan 18 mounted on the housing 4 which is coupled to the temperature controller 12. The fan 18 is preferably used to remove heat which may build up over the filters 6 and/or stage 8. As shown in FIG. 2, the fan 18 is directed to blow air over a heat rejector 11 such as a heat sink which is disposed on the temperature maintenance device 10. The action of the fan 18 increases the amount of heat rejected by the heat rejector 11. The fan 18 may be power constantly or powered intermittently as needed.

In FIG. 2, the filters 6 are shown being disposed directly on top of the temperature maintenance device 10, which is integrated into the bottom of the housing 4. In this regard, one surface of the temperature maintenance device 10 forms a portion of the bottom of the housing 4. Alternatively, a separate stage 8 or heat sink may be used for the filters 6 which is interposed between the housing 4 and the filters 6.

The above-described device 2 is advantageous because relatively small-sized filters 6 are needed to achieve the desired filtering characteristics. Consequently, the overall size or footprint of the device is small compared to current filter devices. Moreover, another advantage of the present device 2 is that normal design and manufacturing techniques can be used to create filters 6 (or resonators) using temperature dependent dielectric materials.

During operation of the device 2, the filters 6 are preferably kept within the temperature range described above. A set-point or target temperature is preferably used as the optimum or nominal temperature of the filters 6. This target temperature is preferably at or around room temperature. Preferably, the target temperature may be programmed into the temperature controller 12. The temperature controller 12 may also be loaded with threshold temperatures which are used to trigger the heating/cooling aspects of the temperature maintenance device 10. For example, if the temperature of a filter 6 rises above the threshold temperature, the temperature controller 12 will then initiate the cooling response (or increase the cooling effect) of the temperature maintenance device 10. Conversely, if the temperature of a filter 6 falls below a threshold temperature, the temperature controller 12 will then initiate a heating response (or increase the heating effect) of the temperature maintenance device 10).

In another aspect of the invention, the one or more filters 6 are tuned by varying the temperature of the filters 6 inside the housing 4. By changing the temperature (either up or down), the filters 6 can be tuned. This may be accomplished, for example, by setting multiple different set-point temperatures.

While the invention has been described principally with regard to use in wireless applications, it should be understood that the present device 2 and method of temperature maintenance may be applied to other fields as well. These include, for example, pulsed power applications which includes electromagnetic-based weapons, high intensity strobe lights, etc. Further, the device 2 and method are applicable to power conditioning applications such as the More Electric Ship, and electric vehicles. Still other applications exist in the medical field (e.g., defibrillators). Essentially, the device 2 and method may be applied to applications where low loss, high dielectric constant materials are needed for small capacitors with high breakdown strengths.

While embodiments of the present invention have been shown and described, various modifications may be made without departing from the scope of the present invention. The invention, therefore, should not be limited, except to the following claims, and their equivalents.

What is claimed is:

1. A dielectric-based filter comprising:

a thermally insulated housing;

at least one filter formed from a dielectric material disposed inside the insulated housing, the dielectric material comprising $TiO_2$ doped with a cation;

a temperature maintenance device having a heating component and a cooling component for maintaining the temperature of the at least one filter inside of the insulated housing within a temperature range.

2. The device of claim 1, wherein the dielectric material comprises $TiO_2$ doped with a cation having a valency ranging from +1 to +6.

3. The device of claim 1, wherein the temperature maintenance device includes at least one temperature sensor.

4. The device of claim 1, wherein the filter is selected from the group consisting of a receive filter or a transmit filter.

5. The device of claim 1, wherein the temperature maintenance device comprises a thermo-electric cooler.

6. The device of claim 1, wherein the interior of the housing is under vacuum.

7. The device of claim 1, wherein the temperature maintenance device includes a fan.

8. The device of claim 1, wherein the at least one filter is mounted on a heat sink.

9. The device of claim 1, wherein the temperature maintenance device comprises a temperature controller for maintaining the temperature of the at least one filter within a temperature range of about +/−0.5 K.

10. The device of claim 9, wherein the temperature maintenance device comprises a temperature controller for maintaining the temperature of the at least one filter within a temperature range of about +/−0.1 K.

11. The device of claim 1, wherein the temperature of the at least one filter inside of the insulated housing is maintained substantially at or around room temperature.

12. The device of claim 11, wherein the temperature of the at least one filter inside of the insulated housing is maintained at a temperature that is within a range of about =/−5° C. of room temperature.

13. The device of claim 1, wherein the temperature maintenance device has a plurality of set-point temperatures for tuning the at least one filter.

14. A method of stabilizing the temperature of dielectric-based filters comprising the steps of:

providing an insulated housing and at least one filter formed from a dielectric material disposed inside the insulated housing, the dielectric material comprisinci $TiO_2$ doped with a cation;

providing a temperature maintenance device having a heating component and a cooling component for maintaining the temperature of the at least one filter within a temperature range;

heating the at least one filter with the heating component when the temperature falls below a threshold value; and cooling the at least one filter with the cooling component when the temperature rises above a threshold value.

15. The method of claim 14, wherein the temperature maintenance device maintains the temperature of the at least one filter within a temperature range of about +/−0.5 K.

16. The method of claim 14, wherein the dielectric material comprises $TiO_2$ doped with a cation having a valency ranging from +1 to 6.

17. A dielectric-based RF sub-system comprising:

a thermally insulated housing;

at least one filter formed from a dielectric material disposed inside the insulated housing, the dielectric material comprising $TiO_2$ doped with a cation;

at least one additional RF sub-system component selected from the group consisting of a LNA, A-to-D converter, and D-to-A converter; and a temperature maintenance device having a heating component and a cooling component for maintaining the temperature of the at least one filter and at least additional RF sub-system component inside of the insulated housing within a temperature range.

18. The device of claim 17, wherein the temperature maintenance device has a plurality of set-point temperatures for tuning the at least one filter.

19. A method of tuning one or more dielectric-based filters comprising the steps of:

providing an insulated housing and at least one filter formed from a dielectric material disposed inside the insulated housing, the dielectric material comprising $TiO_2$ doped with a cation;

providing a temperature maintenance device having a heating component and a cooling component for adjusting the temperature of the at least one filter; and tuning the at least one filter by adjusting the temperature of the at least one filter to one of a plurality of set-point temperatures.

* * * * *